US005215193A

United States Patent [19]

Dennis

[11] Patent Number: 5,215,193

[45] Date of Patent: Jun. 1, 1993

[54] DENTAL STORAGE APPARATUS

[76] Inventor: Lloyd I. Dennis, 855 Corto Ter., Port St. Lucie, Fla. 34983

[21] Appl. No.: 846,028

[22] Filed: Mar. 5, 1992

[51] Int. Cl.[5] ..... B65D 69/00; A45D 40/24; A45D 44/18

[52] U.S. Cl. ..... 206/223; 206/227; 206/229; 206/581; 206/362.1; 132/314; 132/309; 132/310

[58] Field of Search ..... 132/308, 309, 310, 314; 206/581, 223, 362.1, 217, 229, 369

[56] References Cited

U.S. PATENT DOCUMENTS

| | | | |
|---|---|---|---|
| 1,139,134 | 5/1915 | Miller | 206/229 |
| 1,838,687 | 12/1931 | Lawson, Sr. et al. | 132/310 |
| 3,132,653 | 5/1964 | Gazdik | 206/229 |
| 3,894,550 | 7/1975 | Eatoh | 132/310 |
| 4,098,397 | 7/1978 | Mann, Jr. et al. | 206/217 |
| 4,121,600 | 10/1978 | Riddick et al. | 132/314 |
| 5,033,617 | 7/1991 | Hartwein et al. | 206/369 |

*Primary Examiner*—William I. Price
*Attorney, Agent, or Firm*—Leon Gilden

[57] ABSTRACT

A device arranged to include a plurality of containers mounted within a unitary housing, with a first and second container including storage for toothpaste container structure, as well as drinking cups respectively. The housing includes a third container slidably mounting a slide wall therewithin mounting toothbrushes and the like thereon, with the slide wall operative by a dental floss container slidably mounted to a front wall of the housing. A mouthwash dispenser is mounted at an intersection of the first side wall and fluid container utilizing a valve member to effect dispensing of predetermined quantities of mouthwash fluid therefrom.

5 Claims, 4 Drawing Sheets

DENTAL STORAGE APPARATUS

BACKGROUND OF THE INVENTION

1. Field of the Invention

The field of invention relates to dental hygiene apparatus, and more particularly pertains to a new and improved dental storage apparatus wherein the same is arranged to provide for storage and ease of positioning of various components relative to a dental maintenance procedure.

2. Description of the Prior Art

The positioning and dispensing of various components relative to a dental hygiene program is frequently rendered difficult by the various components required to maintain such a program. The instant invention attempts to overcome deficiencies of the prior art by providing such various components arranged for ease of access within a compact unitary storage housing. Prior art structure relative to dental container apparatus is set forth in U.S. Pat. No. 3,867,096 to Doucette wherein cup holder and toothbrush storage rings are mounted relative to a support arranged for wall mounting.

U.S. Pat. No. 4,806,770 to Hylton, et al. sets forth a germicidal toothbrush holder to maintain a toothbrush in a sterilizing container.

As such, it may be appreciated that there continues to be a need for a new and improved dental storage apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of dental storage apparatus now present in the prior art, the present invention provides a dental storage apparatus wherein the same is arranged to provide for the positioning and access to various dental hygiene components. As such, the general purpose of the present invention, which will be described subsequently in greater detail, is to provide a new and improved dental storage apparatus which has all the advantages of the prior art dental storage apparatus and none of the disadvantages.

To attain this, the present invention provides a device arranged to include a plurality of containers mounted within a unitary housing, with a first and second container including storage for toothpaste container structure, as well as drinking cups respectively. The housing includes a third container slidably mounting a slide wall therewithin mounting toothbrushes and the like thereon, with the slide wall operative by a dental floss container slidably mounted to a front wall of the housing. A mouthwash dispenser is mounted at an intersection of the first side wall and fluid container utilizing a valve member to effect dispensing of predetermined quantities of mouthwash fluid therefrom.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved dental storage apparatus which has all the advantages of the prior art dental storage apparatus and none of the disadvantages.

It is another object of the present invention to provide a new and improved dental storage apparatus which may be easily and efficiently manufactured and marketed.

It is a further object of the present invention to provide a new and improved dental storage apparatus which is of a durable and reliable construction.

An even further object of the present invention is to provide a new and improved dental storage apparatus which is susceptible of a low cost of manufacture with regard to both materials and labor, and which accordingly is then susceptible of low prices of sale to the consuming public, thereby making such dental storage apparatus economically available to the buying public.

Still yet another object of the present invention is to provide a new and improved dental storage apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
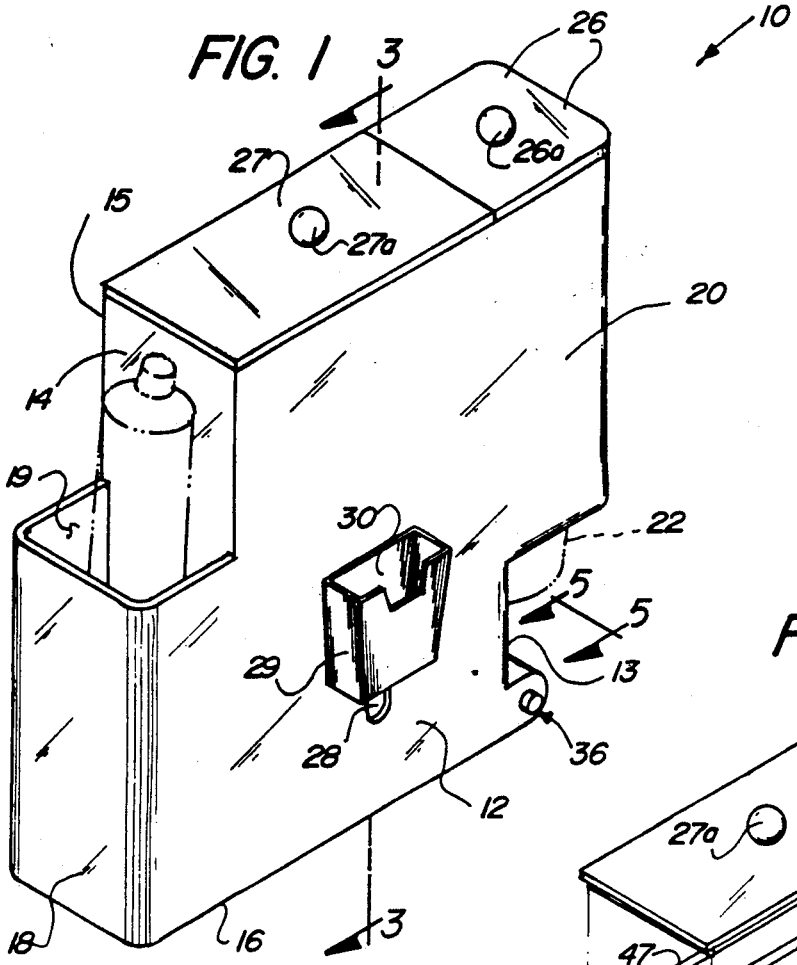
FIG. 1 is an isometric illustration of the instant invention.

With reference now to the drawings, and in particular to FIGS. 1 to 8 thereof, a new and improved dental storage apparatus embodying the principles and concepts of the present invention and generally designated by the reference numeral 10 will be described.

More specifically, the dental storage apparatus 10 of the instant invention essentially comprises the unitary housing 11 formed with a housing front wall 12 spaced from a housing rear wall 15. A housing first side wall 13 is spaced from a housing second side wall 14, with a housing floor 16 extending coextensively and orthogonally between the wall structure. An upper continuous edge 17 is defined by upper distal ends of the housing front, first, second, and rear walls 12–15 respectively. A first container tube 18 whose upper end is positioned below the upper continuous edge 17 extends to the floor 16 and includes a first container cavity 19 therewithin to store various components such as a toothpaste container "T", as illustrated in the FIGS. 1 and 8 for example. It is noted that the first container tube 18 is mounted to the second side wall 14. A second container tube 20 mounted to the first side wall 13 extends from the upper continuous edge 17 a spaced distance from the housing floor 16, with the second container tube 20 including a dispenser cavity 21 directed therethrough to receive and permit dispensing of a nested stack of drinking cups 22.

Figure 3:
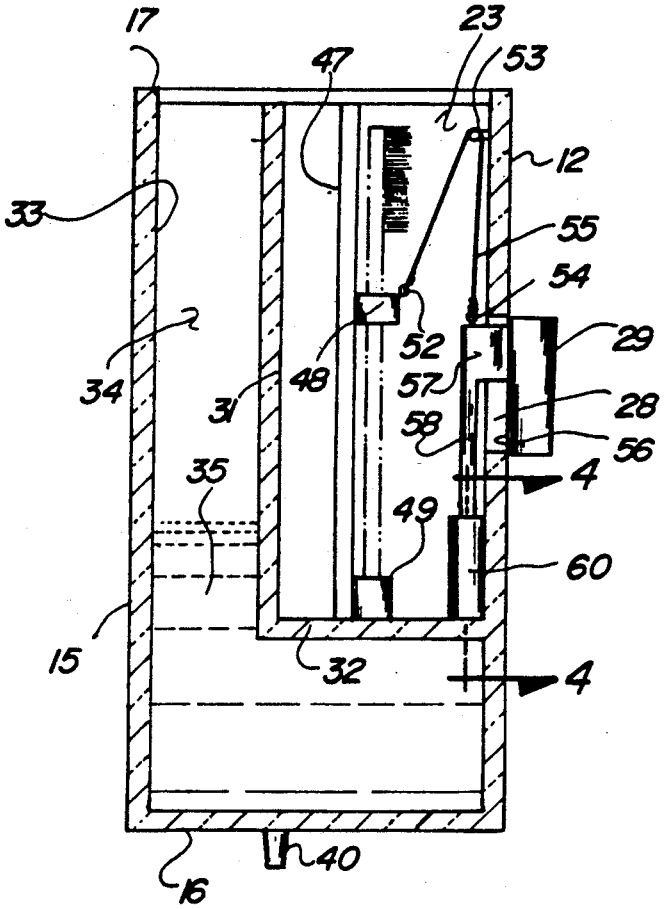
FIG. 3 is an orthographic view, taken along the lines 3—3 of FIG. 1 in the direction indicated by the arrows.
Figure 4:
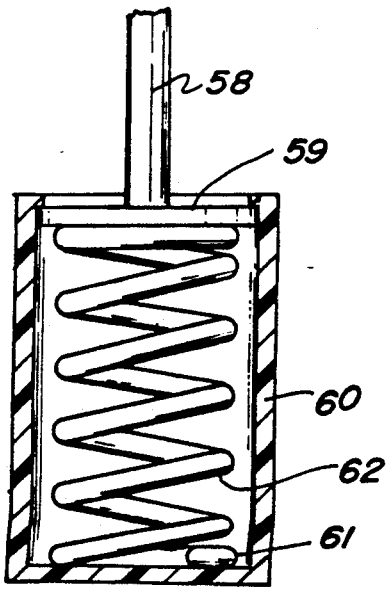
FIG. 4 is an orthographic view, taken along the lines 4—4 of FIG. 3 in the direction indicated by the arrows.
Figure 5:
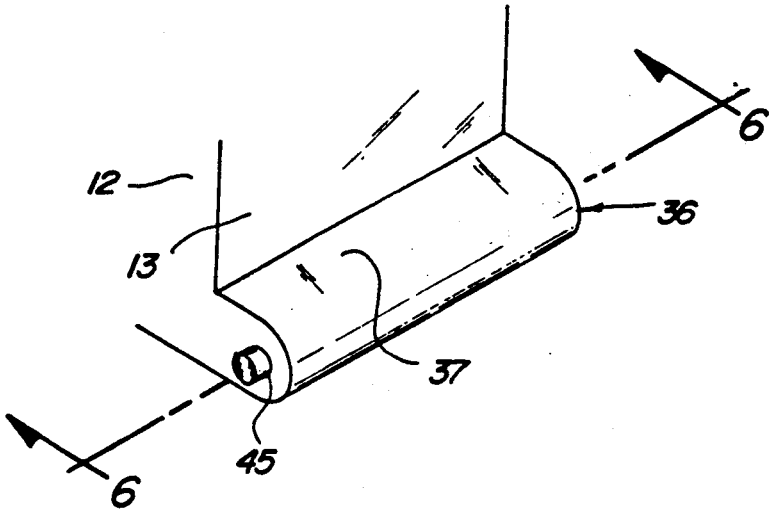
FIG. 5 is an orthographic view, taken along the lines 5—5 of FIG. 1 in the direction indicated by the arrows.

A third container cavity 23 is oriented between housing front wall 12 and a parallel third container partition wall 31 extending orthogonally between the first and second side walls 13 and 14. First side wall slot 24 and second side wall slot 25 are arranged in a parallel coextensive relationship between the first and second side walls in a confronting relationship within the third container cavity 23 to slidingly receive a slide wall 47 therewithin, in a manner to be described in more detail below. The third container cavity 23 is formed with a third container floor 32, as illustrated in FIG. 3.

A second container lid 26 is mounted above the second container and includes a first handle 26*a*. Similarly, a third container cavity lid 27 is mounted to the upper continuous edge 17 and includes a second handle 27*a*, with the second container cavity lid 27 mounted to the upper continuous edge 17 and orthogonally oriented relative to and coextensive with the upper distal end of the third container cavity 23. Similarly, the second container lid 26 is mounted coextensively to an upper distal end of the second container cavity 21.

A front wall slot 28 directed through the front wall is in communication with the third container cavity 23 and mounts a dental floss container 29 slidingly therealong. The dental floss container 29 includes a dental floss container cavity 30 to receive a dental floss container therewithin.

A fourth container 33 (see FIG. 3) is oriented between the housing rear wall 15, the third container partition wall 31, the upper continuous edge 17, and the housing floor 16 to define a fourth container cavity 34 to receive a mouthwash fluid 35 therewithin. An entrance to the fourth container 33 is directed between the housing rear wall 15 and the third container partition wall 31, as illustrated in the FIGS. 2 and 3 for example.

Figure 6:
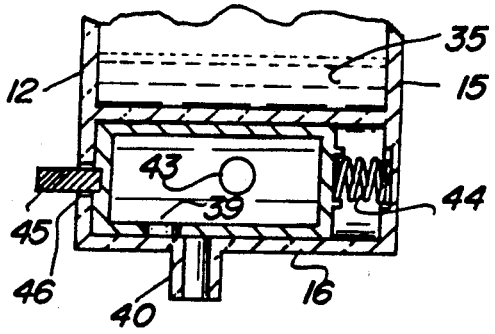
FIG. 6 is an orthographic view, taken along the lines 6—6 of FIG. 5 in the direction indicated by the arrows, in a first position.
Figure 7:
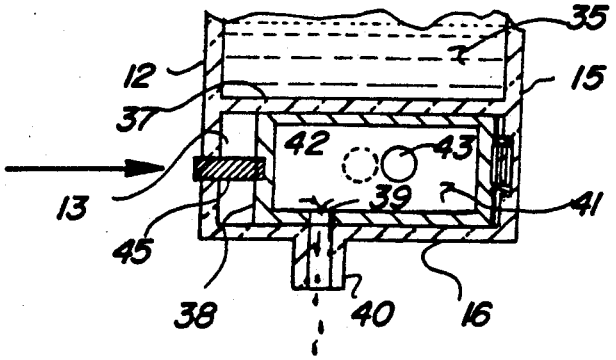
FIG. 7 is an orthographic view of the FIG. 6 in a second displaced position of the metering valve.
Figure 8:
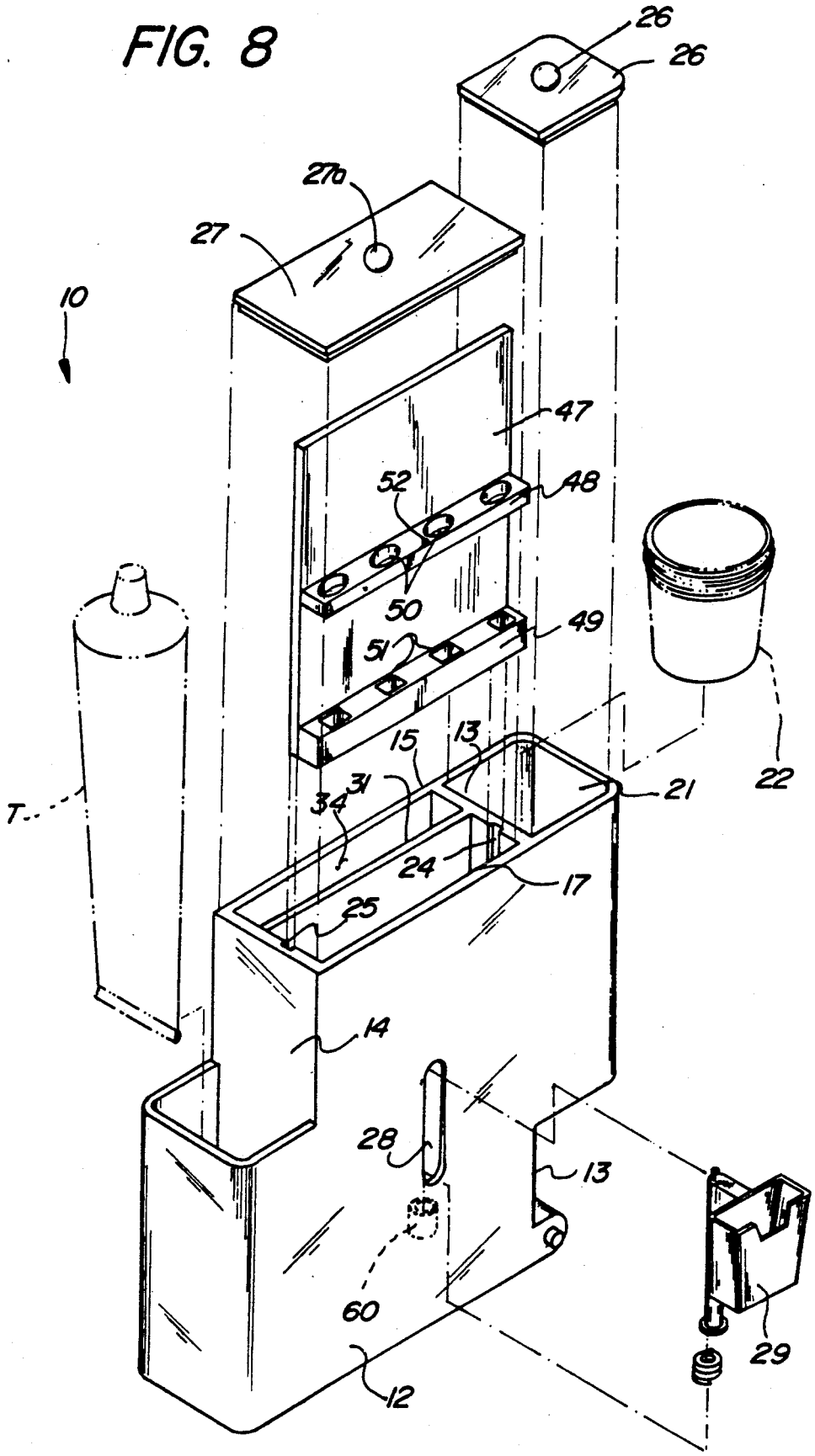
FIG. 8 is an isometric exploded illustration of the invention illustrating the various components thereof.

A metering valve 36 extending at a junction of the first side wall 13 and the housing floor 16 includes a metering valve top wall 37 positioned below the second container tube 20. A valve cylinder 38 is slidably mounted within the metering valve 36 above the floor 16. A valve cylinder first bore 39 is slidably positioned over the housing floor 16 in selective alignment with a housing floor nozzle 40 that is directed downwardly relative to the housing floor 16. The valve cylinder 38 includes a valve cylinder cavity 41, with a first side wall bore 42 aligned with a valve cylinder second bore 43 when the valve cylinder 38 is in a first position. In the first position, the valve cylinder first bore 39 is displaced relative to the housing floor nozzle 40, in a manner as illustrated in FIG. 6. An axial displacement of the valve cylinder 38 within the metering valve body 36, the valve cylinder second bore 43 is displaced relative to the first side wall bore 42 but accordingly aligns the valve cylinder first bore 39 with the housing floor nozzle 40 to dispense a predetermined quantity of mouthwash fluid that is directed into the valve cylinder cavity 41 when the valve cylinder is in the first position, as the first side wall bore 42 is in fluid communication with the fourth container cavity 34 and the mouthwash fluid 35 through the first side wall 13. The valve cylinder 38 includes a valve cylinder spring 44 captured between a first end of the valve cylinder and the interior surface of the housing rear wall 15, with a valve cylinder rod 45 coaxially aligned with the valve cylinder spring 44 directed through a second end wall of the valve cylinder 38 projecting through a front wall rod bore 46, with the valve cylinder rod 45 permitting manual displacement of the valve cylinder from the first position to the second position, as illustrated in the FIGS. 6 and 7 respectively.

As noted above, the slide wall 47 received within the first and second side wall slots 24 and 25 includes a top flange 48 spaced above and parallel a bottom flange 49. The top flange 48 includes top flange space bores 50, with the bottom flange 49 including bottom flange space sockets 51. One of the spaced bores 50 is positioned above and in coaxial alignment with underlying one of said sockets 51 to permit positioning of toothbrushes, as illustrated in the FIG. 2 for example, or other items such as shaving razors and the like.

Figure 2:
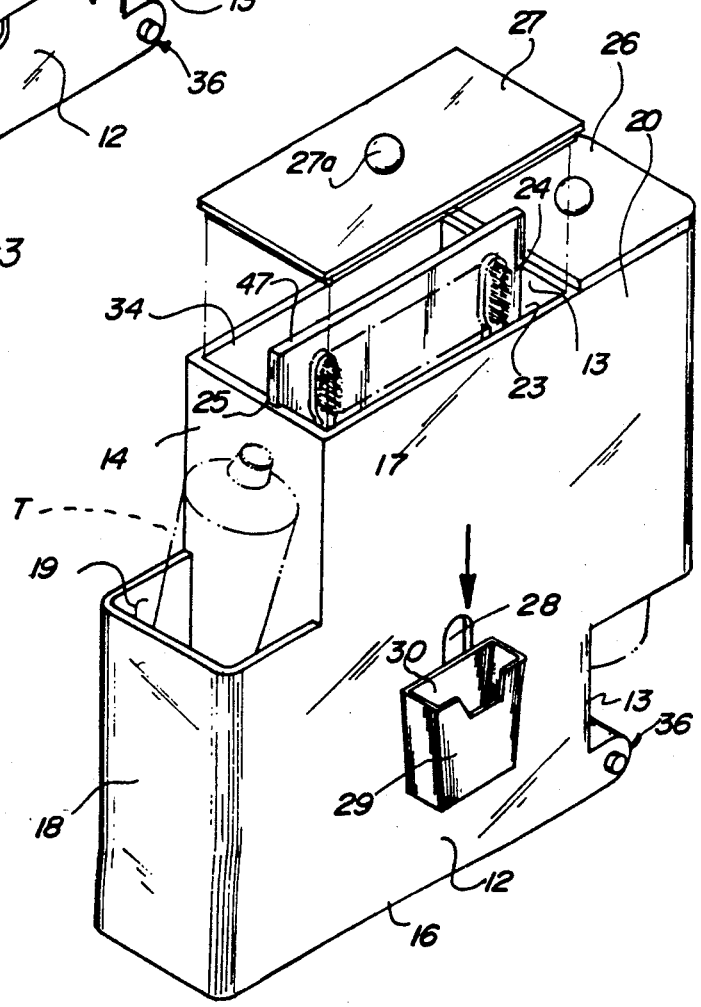
FIG. 2 is an isometric illustration of the invention illustrating one of the lids removed therefrom for access to the third and fourth containers of the organization.

A first anchor mount 52 is mounted to the top flange 50 medially thereof, with a pulley 53 mounted to an interior surface of the front wall 12 within the third container cavity 23. The pulley 53 is mounted above the top flange 48 and positioned in alignment and above a second anchor mount 54. A cable member 55 extends from the first anchor mount 52 slidingly about the pulley 53 and secured at its other end to the second anchor mount 54. The second anchor mount 54 is mounted to a top surface of a dental floss container rear wall boss 57 that is fixedly mounted to a dental floss container rear wall 56 that in turn is in sliding relationship relative to the housing front wall 12. The boss 57 extends through the slot 28 and includes a boss leg 58 extending downwardly therefrom in integral relationship parallel to an interior surface of the front wall 12 within the third cavity 23. A lower distal end of the boss leg 58 includes a boss leg plate 59 that is mounted within a receiving cylinder 60 mounted to the third container floor 32 below the boss leg 58. The receiving cylinder includes a receiving cylinder floor 61 capturing a receiving cylinder spring 62 between the boss leg plate 59 and a receiving cylinder floor 61 to normally bias the leg upwardly to position the boss 57 at an upper end of the slot 28, whereupon depressing of the dental floss container 29 downwardly directs the boss 57 downwardly through the slot 28 and effects tensioning of the cable member 55 and simultaneous lifting of the slide wall 47 for access to the various components stored thereon within the top and bottom flanges 48 and 49, in a manner as illustrated in FIG. 2.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A dental storage apparatus, comprising, a unitary housing, the unitary housing including a housing front wall spaced from a housing rear wall, and a first side wall spaced from a second side wall, and a floor, and the front wall, the first side wall, the second side wall, and the rear wall terminating in a coplanar upper continuous edge, and a first container tube mounted to the second side wall extending from the housing floor to a first container tube position spaced below the upper continuous edge defining a first container cavity between the first container tube and the second side wall, and a second container tube extending along the first side wall and extending from the upper continuous edge to a spaced relationship relative to the housing floor, with the second container tube including a second container dispenser cavity therethrough to receive a nested stack of drinking cups for dispensing from a lower distal end of the second container dispenser cavity, and a third container partition wall extending orthogonally between the housing first side wall and the housing second side wall, and with the third container partition wall arranged parallel to and spaced between the housing front wall and the housing rear wall, the third container partition wall extending downwardly and orthogonally relative to the upper continuous edge terminating in a third container floor, with the third container floor extending from the third container partition wall to the housing front wall defining a third container cavity between the third container partition wall, the third container floor, the housing front wall, and the housing first and second side walls, and a fourth container cavity extending between the third container partition wall, the housing rear wall, and extending from the upper continuous edge to the housing floor, with the housing floor spaced below the third container floor, and the fourth container cavity including a fluid contained therewithin, and a metering valve body mounted to the housing first side wall at an intersection of the housing first side wall and the housing floor, with the metering valve body projecting orthogonally beyond the housing first side wall, the metering valve body including a metering valve body top wall spaced above the housing floor and the metering valve body including a valve cylinder slidably mounted within the metering valve body, with the valve cylinder orthogonally oriented between the housing front wall and the housing rear wall, and the valve cylinder including a valve cylinder first bore, and the housing floor including a housing floor nozzle, the valve cylinder first bore is displaced from the housing floor nozzle in a first position and coaxially aligned and in fluid communication with the housing floor nozzle in a second displaced position.

2. An apparatus as set forth in claim 1 wherein the valve cylinder includes a valve cylinder cavity, and the valve cylinder further including a valve cylinder second bore, and the housing first side wall including a housing first side wall bore coaxially aligned with the valve cylinder second bore in the first position, with the valve cylinder second bore displaced relative to the first side wall bore in the second displaced position, and a valve cylinder spring oriented in coaxial aligned relationship between the valve cylinder and an interior surface of the housing rear wall, with the valve cylinder spring mounted between a valve cylinder first end wall and the housing rear wall, and a valve cylinder rod coaxially aligned with the valve cylinder spring orthogonally mounted to a valve cylinder second end wall, with the valve cylinder rod projecting through the housing front wall, wherein the valve cylinder is displaced from the first position to the second displaced position upon manual projection of the valve cylinder rod into the metering valve body, with the valve cylinder cavity in fluid communication with the fourth container cavity through the valve cylinder second bore and the first side wall bore when the valve cylinder is in the first position.

3. An apparatus as set forth in claim 2 wherein the third container cavity includes a slide wall, the slide wall arranged parallel between the housing front wall and the third container partition wall, and the housing first side wall and the housing second side wall including a respective first side wall slot and a second side wall slot respectively formed within the housing first side wall and the housing second side wall, wherein the first side wall slot and the second side wall slot are arranged in a parallel coextensive relationship between the upper continuous edge and the third container floor orthogonally oriented relative to the third container floor, with a slide wall slidably received within the first side wall slot and the second side wall slot within the third container cavity.

4. An apparatus as set forth in claim 3 wherein the slide wall includes a top flange, the top flange spaced above a slide wall bottom flange mounted to the slide wall, wherein the top flange includes a plurality of top flange spaced bores and the bottom flange includes a plurality of bottom flange sockets, and each of said top flange spaced bores is coaxially aligned and positioned above one of said bottom flange sockets.

5. An apparatus as set forth in claim 4 including a slot directed through the housing front wall into the third container cavity, and a dental floss container mounted to the front wall, with the dental floss container including a dental floss container rear wall in contiguous and sliding communication to the housing front wall, and a dental floss container rear wall boss directed through the slot into the third container cavity, and the boss including a boss leg positioned within the third container cavity arranged parallel to the housing front wall extending downwardly relative to the boss, with the boss leg terminating in a boss leg plate at a lower distal end of the boss leg, and a receiving cylinder fixedly mounted to the third container floor, with the receiving cylinder receiving the leg plate therewithin, and the receiving cylinder including a receiving cylinder floor and a receiving cylinder spring captured between the leg plate and the receiving cylinder floor to bias the leg plate in a spaced relationship relative to the receiving cylinder floor, and a first anchor mount mounted to the top flange, and a pulley mounted to the housing front wall within the third container cavity spaced above the slot, and a second anchor mount mounted to the boss, with a cable member extending from the first anchor mount wound about the pulley and secured to the second anchor mount, whereupon downward deflection of the dental floss container effects tensioning of the cable member and lifting of the slide wall.

* * * * *